United States Patent [19]

Dean

[11] 4,344,590

[45] Aug. 17, 1982

[54] TORQUE LIMITING DEVICE

[75] Inventor: Terence F. Dean, High Wycombe, England

[73] Assignee: EMI Limited, Hayes, England

[21] Appl. No.: 165,717

[22] Filed: Jul. 3, 1980

[30] Foreign Application Priority Data

Jul. 7, 1979 [GB] United Kingdom ..... 7923800

[51] Int. Cl.[3] ..... G03B 1/04; G11B 15/32

[52] U.S. Cl. ..... 242/201; 242/67.1 R; 346/136

[58] Field of Search ..... 242/200–204, 242/205, 67.4, 67.1, 67.2, 208–210; 40/518, 519, 523, 471; 346/33 D, 136; 226/188; 74/660, 661, 665 F, 711

[56] References Cited

U.S. PATENT DOCUMENTS 3,505,903 4/1970 Grass ..... 74/661

3,792,825 2/1974 Kampf ..... 346/136

*Primary Examiner*—Leonard D. Christian

*Attorney, Agent, or Firm*—Fleit & Jacobson

[57] ABSTRACT

A clutch arrangement for a spool mechanism. The arrangement comprises two clutches, namely an over-running clutch and a constant torque clutch whose respective driven members are connected to the spool bearing and whose driving members are capable of being connected to a drive means. The over-running clutch transmits to the bearing a torque which is substantially greater than the torque applied by the constant torque clutch.

6 Claims, 7 Drawing Figures

TORQUE LIMITING DEVICE

Figure 1:
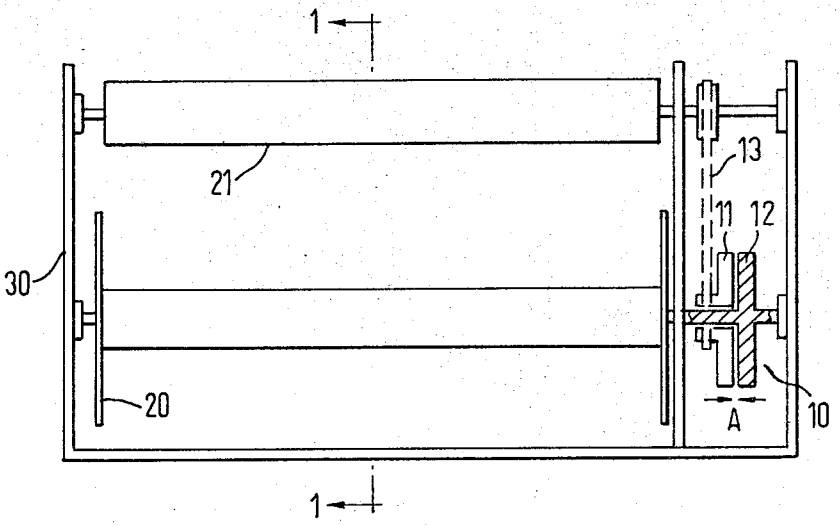

This invention relates to clutch arrangements and particularly to clutch arrangements suitable for use in a spooling device.

It is generally preferred that the output from a chart or tape recorder should be collected on a "take up" spool as soon as data or information has been recorded. Especially in the case of chart recorders this may be achieved with economy by using the drive for the recorder output (for example, a capstan which delivers the recorder paper for collection at the output) to also drive the "take up" spool. The output drive in a chart recorder is usually of the constant speed type and must, therefore, be coupled to the spool in such a way that the rotation speed of the spool varies to compensate for a change in its effective radius as the quantity of the spooled output changes. Typically the speed of the spool may have to be varied by as much as 2000 revs/-min.

To achieve this object the spool may be coupled to the drive by means of a constant torque clutch, but in a practical example whilst this arrangement performs adequately at relatively low transport speeds (i.e. chart recorder speeds of up to about 2m/s) the arrangement proves to be unsatisfactory when higher speeds are used (i.e. between 2 and 5 m/s). At these relatively high speeds it is found that an excessively high torque must be transmitted to the take up spool during the initial stages of acceleration (i.e. before the chart paper has acheived a steady speed) in order to prevent the spool lagging behind the paper and causing an unacceptable overrun. It is found, however, that if such high torques are applied the power consumption of the recorder output drive is so high that the maximum attainable transport speed is reduced. There is also an increase in the tension developed in the paper which may be unacceptable.

It is an object of the present invention to provide an improved form of clutch arrangement which substantially overcomes the problems outlined above.

According to one aspect of the invention there is provided in a recording apparatus having a drive means for transporting recorded paper or tape to an output location, a spooling arrangement comprising:

a rotary bearing for a spool, means for supporting the bearing adjacent to the output location at a position appropriate for spooling the transported paper or tape and a constant torque clutch and an over-running clutch whose respective driven members are coupled to said bearing and whose respective driving members are coupled to said drive means, wherein the over-running clutch is capable of transmitting to said bearing a torque substantially greater than the maximum torque rovided in operation by the constant torque clutch, and adopts the free-running mode when the transport speed of the paper or tape attains a preselectd value substantially less than the maximum attainable transport speed.

Preferably the constant torque clutch is a constant torque magnetic clutch.

The over-running clutch may adopt the free-running mode when the torque transmitted thereby to the bearing substantially equals said maximum torque provided by the constant torque clutch.

The driving members may be coupled by pulley means to a capstan which is capable of being drivingly engaged by the said drive means.

According to another aspect of the invention there is provided a chart recorder incorporating a spooling arrangement as described above.

Figure 2:
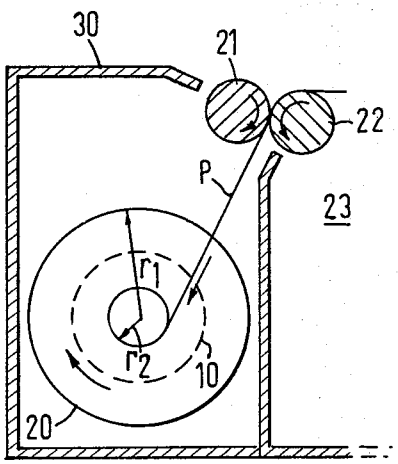
Figure 3:
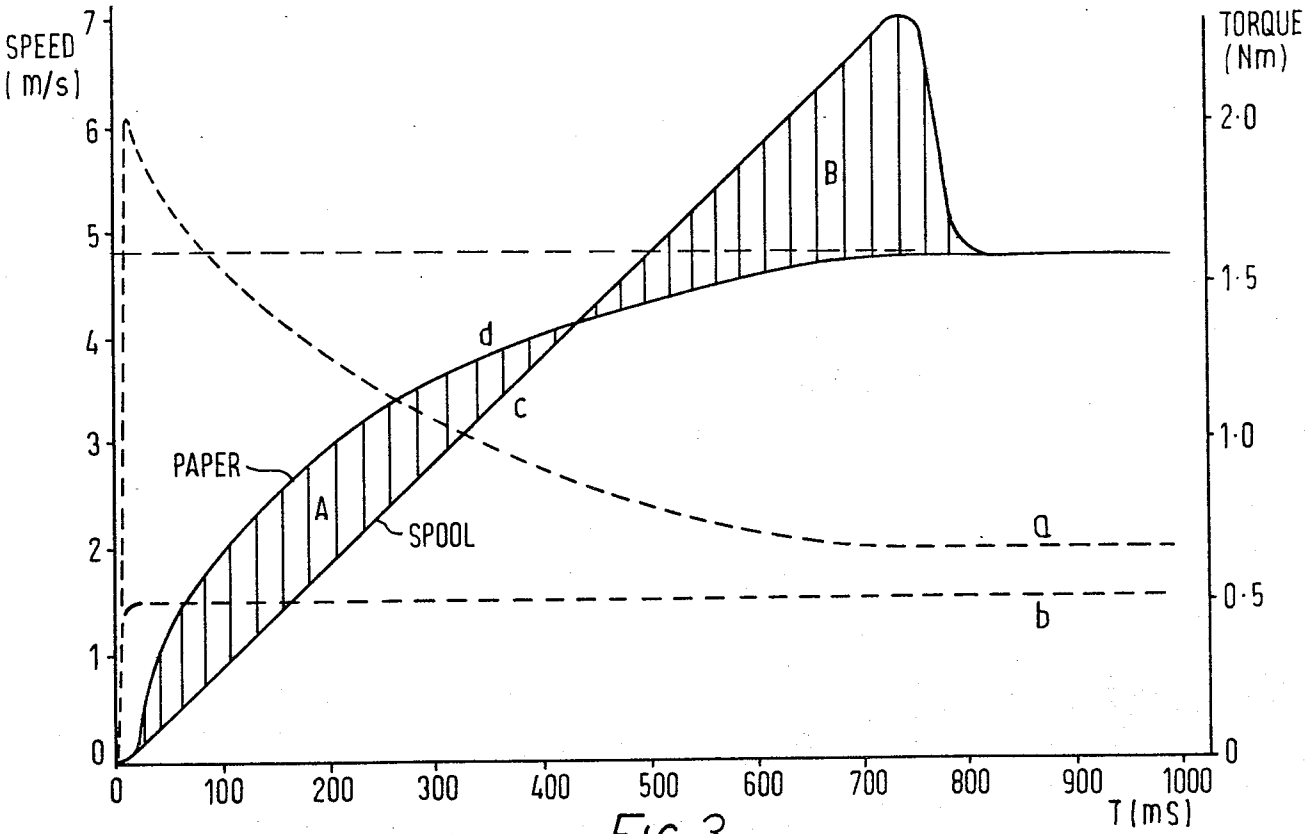
Figure 5:
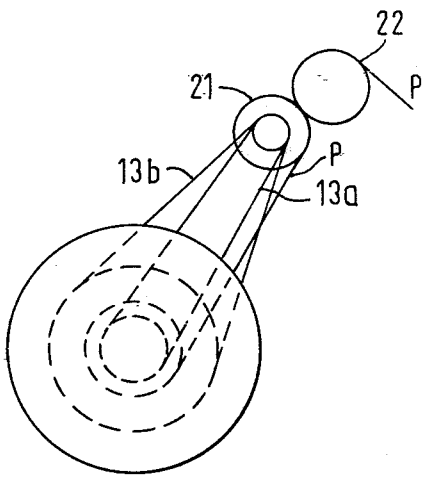
Figure 4:
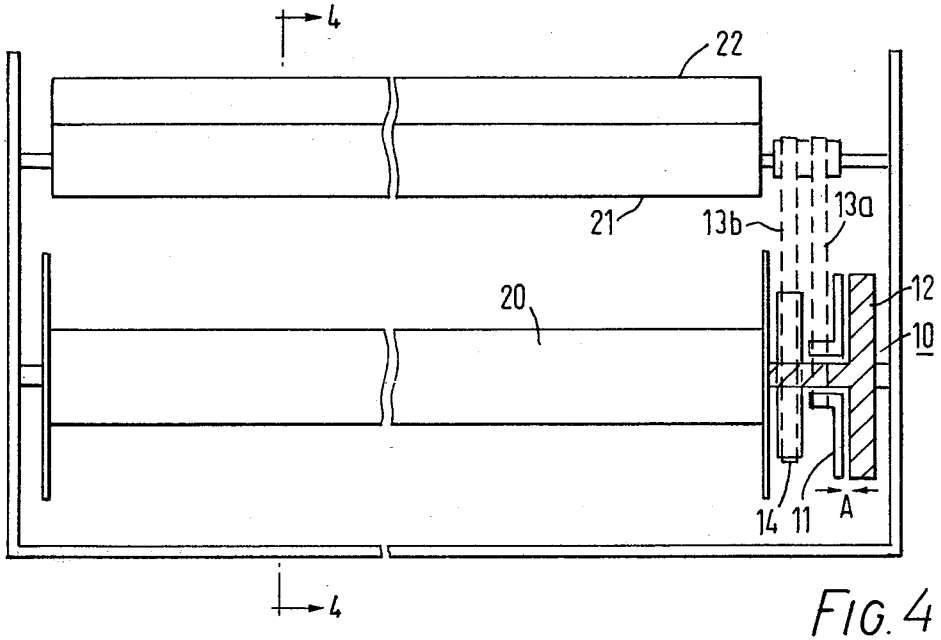
Figure 6:
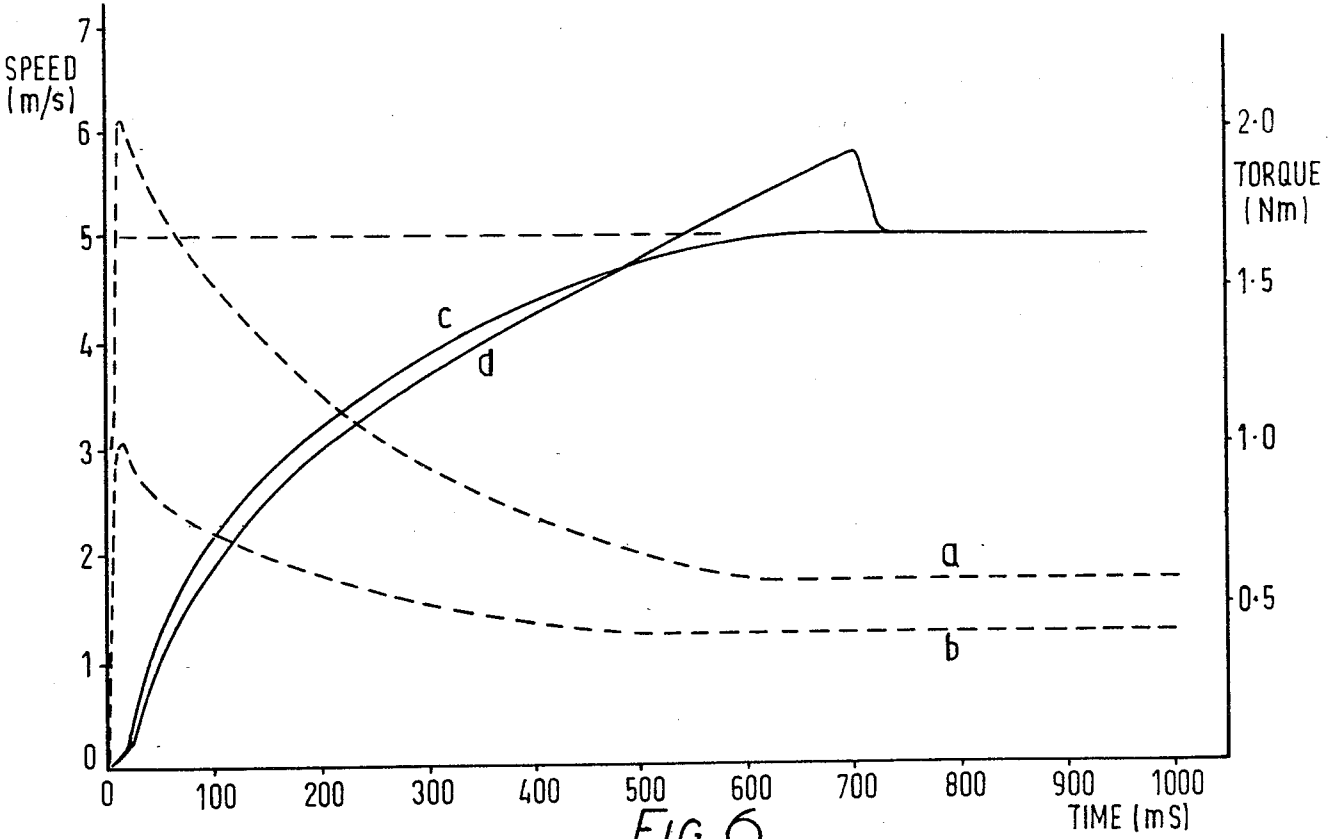
Figure 7:
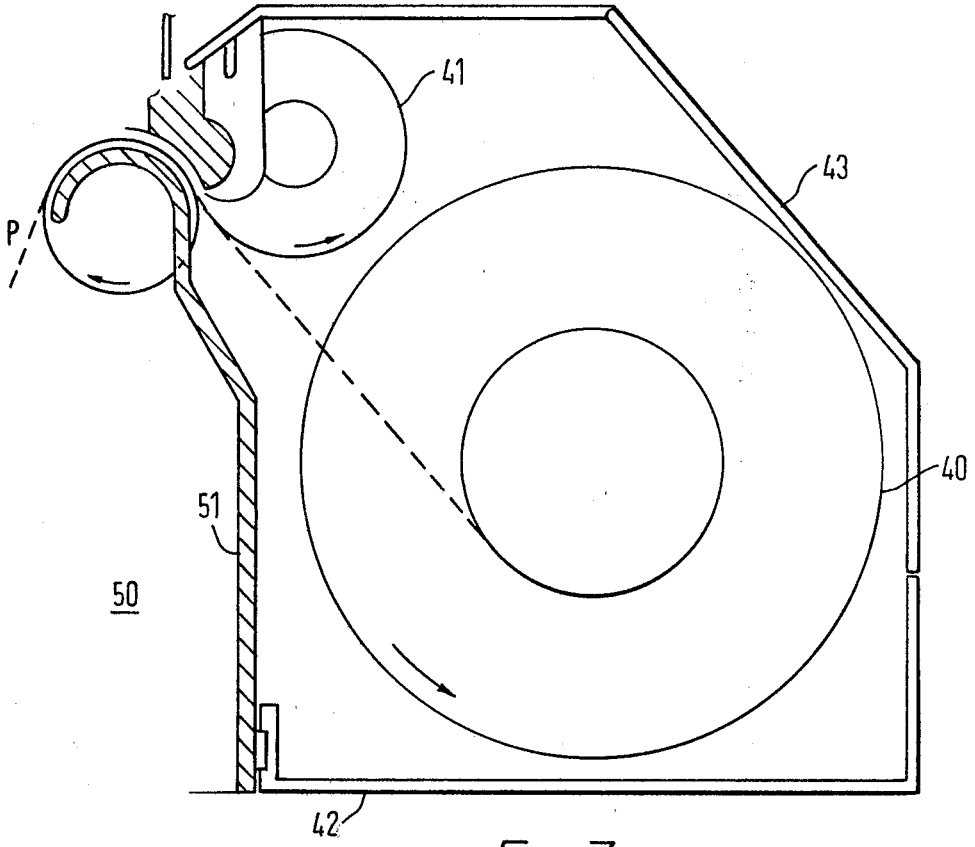

In order that the present invention may be more readily understood and carried into effect a specific embodiment thereof will be described by way of example by reference to the accompanying drawings of which:

FIG. 1 shows a front elevation view, partly in section of a spooling arrangement incorporating a constant torque clutch, FIG. 2 shows an end elevation view, partly in section, taken on the line 1—1 in FIG. 1, FIG. 3 illustrates the spooling performance of the arrangement illustrated in FIGS. 1 and 2, FIG. 4 shows a front elevation view, partly in section, of an improved spooling arrangement in accordance with the instant invention, FIG. 5 shows an end elevation view, taken on line 4—4 in FIG. 4, and illustrating the arrangement of clutches, spool capstan and drive shown in FIG. 4, FIG. 6 illustrates the spooling performance of the arrangement illustrated in FIGS. 4 and 5, and FIG. 7 shows an end elevation view, partly in section, taken on the line 4—4 in FIG. 4 of a detachable spool arrangement for use in a chart recorder.

As explained earlier an arrangement which uses a constant torque clutch only, to transmit a drive to the "take up" spool is found to operate unsatisfactorily at relatively high transport speeds.

Such an arrangement is now briefly described by reference to FIGS. 1 and 2 which respectively represent the end and side views of the arrangement.

The chart recorder paper, indicated at P in FIG. 2, is delivered from the chart recorder, 23, by means of a drive capstan, 22. The spooling arrangement is contained within a housing, 30, and is comprised of a capstan, 21, which engages the drive, 22, and is coupled by a pulley, 13, so as to transmit the drive to the take up spool, 20. For most practical purposes it is desirable that the spool, 20, should be capable of holding a considerable length of paper (of the order of 60–80 m, say) and so it is clear that the effective spool radius varies (between $r_1$ and $r_2$, as indicated in FIG. 2) as the quantity of spooled paper changes. Since the recorder output drive, 22, is typically of the constant speed type it is necesary to provide a coupling arrangement whereby the speed of rotation of the spool is suitably adjusted to compensate for a change in its effective radius and this is achieved by the use of a constant torque clutch, 10, which irrespective of the load applied by the driving motor ensures that a substantially constant torque is transmitted to the bearing for the take up spool. The type of constant torque clutch used and the details of its construction are described fully below.

The performance of the above described arrangement during the initial stages of spooling (i.e. when the spool is accelerated from rest) is illustrated in FIG. 3 for the highest attainable paper speed; 5 m/s in this case. The dashed curves, a and b, of FIG. 3 respectively illustrate the variation with time of the torque developed by the drive means, 22, and the corresponding torque transmitted to the spool, 20. During the first few milliseconds the transmitted torque rises steadily in response to the load applied by the motor but once this torque has reached a preset value (0.5 Nm in the above-described arrangement) the clutch begins to slip and the transmitted torque then remains substantially constant even when the torque applied to the clutch by the motor is well in excess of this value. In consequence, the initial acceleration of the spool remains substantially constant as can be deduced from the substantially constant slope of curve c of FIG. 3. Particularly when relatively high transport speeds (between 2 and 5 m/s) are used it is found that the initial acceleration of the chart recorder paper, as indicated by the slope of curve d of FIG. 3, exceeds that of the spool and an excessively large overrun of paper develops. This overrun is represented by the shaded area, A, between curves d and c. When much lower transport speeds, up to about 2 m/s say, are used the initial acceleration of the paper is considerably smaller and the problem of overrun is found to be relatively unimportant.

As the acceleration of the paper decreases the speed of the spool eventually overtakes that of the paper until such time as the overrun is recovered (i.e. so that the shaded areas A and B are equal) and constant spool and paper speeds are then achieved. Under the most optimum conditions, however, (i.e. by the transmission to the spool of a torque of 0.5 Nm) it is found that the paper overrun is unacceptably high (~1.5 m) and, moreover, particularly when the spool is full, the power consumption of the driving motor is so high that the maximum nominal chart recorder speed of 5 m/s cannot quite be attained. Clearly higher torques could be applied to the spool to reduce the overrun, but this would also have the effect of further reducing the maximum attainable chart recorder speed. The arrangement of the present invention, which is illustrated in FIGS. 4 and 5, substantially overcomes the problems outlined above.

Referring to FIGS. 4 and 5, the chart paper, P, is again delivered from the recorder by means of an output drive, 22, which engages a capstan, 21. The capstan, 21, is coupled to the spool by means of two independent pulleys, 13*a* and 13*b*. One of the pulleys, 13*a*, is coupled to a constant torque clutch, 10, as described above.

In the arrangements described throughout this specification a particular type of constant torque clutch, namely a constant torque magnetic clutch, has been used. It will be appreciated, however, by a person skilled in the art, that other forms of clutch, providing similar operational characteristics (i.e. clutches which provide a substantially constant torque) could be used, and it will be readily envisaged how the arrangements of the present invention may be adapted for the incorporation of such another clutch.

It will be seen from FIG. 4 and FIG. 2 that the constant torque magnetic clutchs illustrated therein at 10, are comprised of two opposed plates, 11 and 12, formed of magnetic material, which are separated by an air gap, A, and are arranged for rotation about a common axis, which in this case is the axis of spool, 20.

The driving plate, 11, is usually comprised of spaced regions of a permanent magnetic material forming alternate North and South poles around the plate, and which act to induce an alternating magnetic field within the unmagnetized ferromagnetic material of the driven plate, 12. The forces produced by the action of this field only weakly couple the two plates so that when the load to the driving plate, 11, exceeds a preset level (determined by the size of the air gap, A) slippage occurss sso that the transmitted torque remains substantially constant.

It will be appreciated that in practice the torque transmitted by such a constant torque magnetic clutch varies slightly with the degree of slippage, and a roughly linear relationship is exhibited. This small variation is due to the Foucault currents which circulate within the plates which are rotating at relatively different speeds when slippage occurs.

The other pulley, 13*b*, indicated in FIG. 4, couples the drive means to the spool via a second clutch, 14, which is a free wheeling or over-running clutch. Such clutches are well known in the art and are readily available, and have the effect of transmitting a torque until such time as the driving member approaches a preset angular velocity at which point the transmitted torque falls to zero and the clutch free-wheels. By adopting this arrangement the initial acceleration of the spool, 20, is provided by the free running clutch preferably until the torque applied thereby equals the constant torque which can be provided by clutch, 10. At this point clutch, 10, takes over the drive and clutch, 14, adopts the free-running mode. The performance of such an arrangement can be selected by a suitable choice of the gearing ratios of the two pulley drives. The performance of the arrangement is illustrated in FIG. 6 and it is seen that the initial speed of the spool (curve d) closely follows the speed of the paper (curve c) and so the area between the curves is considerably reduced thereby preventing a serious overrun of paper. Furthermore, because the constant torque clutch is not used to provide an initial high acceleration (this is now provided by the free-running clutch) the constant torque which it provides can be reduced slightly (to about 0.40 Nm) to a level such that the power consumption of the motor permits the attainment of the full nominal paper speed of 5 m/s. The torque provided by clutch, 10, is still sufficient, however to compensate for the small degree of paper overrun which occurs and a steady paper speed can be achieved within about 600 ms which for most practical purposes is adequate.

A practical arrangement suitable for use with a chart recorder is illustrated in side view in FIG. 7. The spool, 40, and the capstan, 41, are contained within a housing, 42, which is designed to be clipped to the end, 51, of the chart recorder, 50. A hinged flap, 43, is provided in the housing to facilitate the removal of the spool. Clearly in another embodiment the arrangement may be built into the chart recorder.

Although a specific embodiment has been described it will be appreciated that the present invention may be applied to other transport arrangements requiring the application of an initially high torque (to produce a high acceleration) which if sustained for more than a limited period would have an adverse effect on subsequent operation of the drive. The invention also enables this high torque to be applied to the take-up spool without a similarly high tension being developed in the paper when the torque is not actually required for acceleration.

What I claim is:

1. A spooling device for use in a recording apparatus having a drive means for transporting recorded paper or tape to an output location, the device comprising:

a rotary bearing for a spool, means for supporting the bearing adjacent the output location at a position appropriate for spooling transported paper or tape, a constant torque clutch and an over-running clutch each having a driving member and a driven member, the driven members being coupled to the bearing and the driving members being adapted to be driven by the drive means, wherein the over-running clutch is capable of transmitting to said bearing a torque substantially greater than the maximum torque provided in operation by the constant torque clutch, and adopts the free-running mode when the transport speed of the paper or tape attains a preselected value substantially less than the maximum attainable transport speed.

2. A spooling device according to claim 1 wherein the constant torque clutch is a constant torque magnetic clutch.

3. A spooling device according to claims 1 or 2 wherein the over-running clutch adopts the free-running mode when the torque transmitted thereby to the bearing substantially equals the said maximum torque provided by the constant torque clutch.

4. A spooling device according to claim 1 including a capstan to engage the drive means, and respective pulley means for coupling each said driving member to the capstan.

5. A chart recorder incorporating a spooling device according to any one of claims 1, 2, or 4.

6. A chart recorder incorporating a spooling device according to claim 3.

* * * * *